US009328452B2

(12) United States Patent
Hong et al.

(10) Patent No.: US 9,328,452 B2
(45) Date of Patent: May 3, 2016

(54) LAUNDRY MACHINE HAVING A DRYING FUNCTION

(71) Applicant: LG ELECTRONICS INC., Seoul (KR)

(72) Inventors: Sang Wook Hong, Seoul (KR); Young Suk Kim, Seoul (KR); Hyun Seok Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 105 days.

(21) Appl. No.: 14/081,306

(22) Filed: Nov. 15, 2013

(65) Prior Publication Data

US 2014/0115913 A1 May 1, 2014

Related U.S. Application Data

(62) Division of application No. 13/638,666, filed as application No. PCT/KR2010/003414 on May 28, 2010.

(30) Foreign Application Priority Data

Apr. 2, 2010 (KR) ..... 10-2010-0030436

(51) Int. Cl.

| | |
|---|---|
| ***D06F 58/04*** | (2006.01) |
| ***D06F 25/00*** | (2006.01) |
| ***D06F 58/02*** | (2006.01) |
| ***D06F 58/24*** | (2006.01) |

(52) U.S. Cl.

CPC ..... *D06F 58/04* (2013.01); *D06F 25/00* (2013.01); *D06F 58/02* (2013.01); *D06F 58/24* (2013.01)

(58) Field of Classification Search

CPC ..... D06F 58/24; D06F 58/02; D06F 58/04; D06F 25/00

See application file for complete search history.

(56) References Cited

U.S. PATENT DOCUMENTS

| | | | | |
|---|---|---|---|---|
| 1,764,476 | A | 6/1930 | Smith et al. | 68/174 |
| 2,937,516 | A | 5/1960 | Czaika | 68/58 |
| 3,018,562 | A | 1/1962 | Orr | 34/75 |
| 3,073,668 | A | 1/1963 | Rothenberger | 68/24 |
| 2005/0229650 | A1 | 10/2005 | Kim et al. | |
| 2005/0252029 | A1 | 11/2005 | Kim | 34/596 |
| 2006/0016228 | A1 | 1/2006 | Chang et al. | 68/23.1 |

(Continued)

FOREIGN PATENT DOCUMENTS

| | | |
|---|---|---|
| EP | 1 840 257 A1 | 10/2007 |
| GB | 2 291 891 A | 2/1996 |
| JP | 2004-113790 | 4/2004 |

(Continued)

OTHER PUBLICATIONS

Korean Notice of Allowance issued in Application No. 120020128403 dated Oct. 14, 2013.

(Continued)

*Primary Examiner* — Jiping Lu

(74) *Attorney, Agent, or Firm* — Ked & Associates LLP

(57) ABSTRACT

A laundry machine having a drying function for drying an object to be dried, especially clothes. The laundry machine according to one embodiment of the present invention may be a circulating drying machine that supplies the hot air to an object to be dried, so as to remove water, and then condenses the water from the hot air and heats the condensed water to supply the heat to the object to be dried. At this time, condensing may be carried out using natural convection.

28 Claims, 12 Drawing Sheets

(56) References Cited

U.S. PATENT DOCUMENTS

| | | | | |
|---|---|---|---|---|
| 2006/0225467 | A1* | 10/2006 | Lim et al. | 68/20 |
| 2010/0089102 | A1 | 4/2010 | Chang | 68/140 |

FOREIGN PATENT DOCUMENTS

| | | |
|---|---|---|
| KR | 10-2005-0066519 | 6/2005 |
| KR | 10-2006-0077271 | 7/2006 |
| WO | WO 2008/030053 | 3/2008 |

OTHER PUBLICATIONS

International Search Report issued in PCT Application No. PCT/KR2010/003414 dated Jan. 21, 2011.

Russian Office Action dated Aug. 7, 2013 issued in Application No. 2012142307/12 (with English translation).

* cited by examiner

LAUNDRY MACHINE HAVING A DRYING FUNCTION

CROSS-REFERENCE TO RELATED APPLICATION(S)

This present application is a divisional of U.S. patent application Ser. No. 13/638,666 filed on Oct. 1, 2012, which is a National Stage Application of PCT/KR2010/003414 filed May 28, 2010, which claims priority to Korean Application No. 10-2010-0030436 filed in Korea on Apr. 2, 2010, the entire contents of which are hereby incorporated by reference herein.

TECHNICAL FIELD

The present invention relates to a machine having a drying function for drying an object to be dried, especially clothes. The machine can be referred to as a laundry machine having a drying function.

Examples of the laundry machine having a drying function include a drying machine having a drying function only and a laundry machine having a drying function together with a laundry function of clothes. Also, an example of the laundry machine includes a drum type laundry machine and a cabinet type laundry machine depending on a structure or type, wherein the drum type laundry machine dries laundry while tumbling the laundry using a rotatable drum, and the cabinet type laundry machine dries laundry by hanging the laundry up.

BACKGROUND ART

Examples of the laundry machine having a drying function include a drying machine having a drying function only and a laundry machine having a drying function together with a laundry function of clothes. Also, an example of the laundry machine includes a drum type laundry machine and a cabinet type laundry machine depending on a structure or type, wherein the drum type laundry machine dries laundry while tumbling the laundry using a rotatable drum, and the cabinet type laundry machine dries laundry by hanging the laundry up.

Generally, a laundry machine having a drying function according to the related art includes a tub receiving washing water for washing. A drum where laundry is placed is rotatably provided within the tub.

The drum is connected with a rotational shaft, and a motor is used to rotate the rotational shaft.

The rotational shaft is rotatably supported through a bearing housing provided at a rear wall of the tub. The tub is connected with a suspension, and vibration of the drum and the tub is absorbed by the suspension.

For a drying function, the laundry machine includes a drying duct and a condensing duct. The drying duct is placed at a top portion of the tub and is provided with a heater and a fan therein. One end of the condensing duct is connected with the tub, and the other end of the condensing duct is connected with the drying duct.

Cooling water is supplied into the condensing duct to condense water contained in the wet air. The wet air flows into the drying duct after being condensed in contact with the cooling water while flowing along the condensing duct. In this way, the hot air returning to the drying duct is reheated by the heater and then is supplied into the tub again.

DISCLOSURE OF INVENTION

Technical Problem

An object of the present invention is to provide a laundry machine that condenses water through a natural cooling mode without a separate forcible cooling means. In other words, one embodied laundry machine may use natural convetion for condensing moistured hot air.

Another object of the present invention is to provide a laundry machine having an improved condensing rate if condensing is carried out by a forcible cooling means such as cooling water.

Solution to Problem

A machine according to one embodiment of the present invention could be a circulating drying machine that supplies the hot air to an object to be dried, so as to remove water, and then condenses the water from the hot air and heats the condensed water to be supplied to the object to be dried. At this time, the circulating drying machine could be a laundry machine having a drying function.

A drying rate is related to a rate per time removing the water from the object to be dried. Such a drying rate is related to a condensing rate in the circulating drying machine. If the condensing rate is high, the drying rate also becomes high, whereby a drying time can be reduced.

The condensing rate is related to a flow rate of the hot air and a temperature difference between the temperatures of the hot air before and after condensed.

Generally, the higher the temperature difference, the more demoisturized the hot air is and therefore the more amount of moisture is removed from the object to be dried. The temperature difference may be related to a cooling method during condensing. For example, there is provided a forcible cooling means that uses a separate cooling means such as cooling water or forcibly blown cooling air.

Also, if the flow rate of the hot air increases, it means that an amount of the hot air per time supplied to the object to be dried increases. Accordingly, the amount of the water that can be condensed increases, whereby the condensing rate can be increased.

If the flow rate of the hot air increases, a desired drying or condensing rate can be obtained even though the temperature difference is not that high.

If the flow rate of the hot air increases at a certain level or greater, a separate forcible cooling means may not be required. In other words, without using forcible cooling means, a natural cooling drying machine may be provided with an increased flow rate.

Also, increasing the flow rate together with using forcible cooling means could lead to an increase of the condensing rate. If the flow rate is high enough for the forcible cooling means not to be required, a natural cooling drying machine can be obtained.

Accordingly, according to one embodiment of the present invention, the laundry machine may be a machine that dries the object to be dried by condensing the water through natural cooling without using forcible cooling means. According to another embodiment of the present invention, the laundry machine could be a machine having an improved condensing or drying rate by condensing the hot air by forcible cooling means with an increased flow rate of the hot air.

Particularly, a natural cooling drying machine will be described in more detail.

In the case that a tub serves as a condensing chamber and condenses the water through natural cooling, heat exchange is made on the outside surface thereof through natural convection. As a result, the wet air is in contact with the inside of the cooled tub to be condensed.

When the tub serves as a condensing chamber, in any location inside of the tub could the condensing occur only if a temperature at the location is lower than inside a drum. According to this embodiment, although a top portion of the tub may be affected by a heater, many other portions between the drum and the tub can be used as a condensing space. In this case, the hot air may be condensed on 40% or over of the total inner surface of the tub.

If the condensing duct is not used, the hot air circulates in a way that it flows in the order of 'drying duct-drum-tub-drying duct.' In this case, the 'tub' means the portion between the drum and the tub. Since no condensing duct is provided, the hot air discharged from the tub directly flows into the drying duct.

For effective natural cooling within the tub, 50% or more amount of the hot air flown in from the drying duct can be maded to flow into the drum. In other words, the hot air flowing into the drum is more than that flowing between the tub and the drum. To this end, a hot air inlet of the tub may be placed in front of a laundry entrance opening of the drum.

Even in case of natural cooling, a condensing plate of a metal material may be placed into the condensing chamber. In particular, if the condensing chamber is made of plastic, a condensing rate can be increased using the condensing plate of a metal material.

If the tub serves as the condensing chamber, the condensing plate may be placed at the center of a sidewall of the tub. At this time, the hot air outlet of the tub is formed above the condensing plate. The condensing plate may be spaced apart from the hot air outlet at a certain distance. This is to reduce flowing of the condensed water, which is formed on the surface of the condensing plate, into the hot air outlet through the hot air. If the condensing plate is to be titled towards a lower part of the tub, the wet air discharged from the drum may be discharged to the hot air outlet without contact with the condensing plate. Accordingly, it is preferable that the condensing plate is placed at the center of the sidewall of the tub.

Meanwhile, a method for increasing an air flow will be described. As described above, if the air flow increases, the condensing rate can be increased in the forcible cooling mode. Even though the forcible cooling means is not used, the natural cooling drying machine having a desired drying rate can be obtained by increasing the flow rate.

Examples of the method for increasing an air flow includes a method for increasing an input power of a fan and a method for reducing resistance applied to the hot air at a passage where the hot air circulates.

However, if the input power of the fan increases and the flow speed of the air increases with the same flow passage, the resistance of the passage to the air flow may increase.

The flow passage of the hot air may be required to have lower resistance to increase the flow rate. A method for reducing resistance of the passage includes simplifying the circulating passage and decreasing a length of the circulating passage. Examples of reducing resistance of the passage include flowing the hot air into the drum by changing the hot air inlet, not using the condensing duct, reducing an angle between a discharging direction of the hot air discharged from the tub and an inlet direction of the hot air flowing into the fan of the drying duct.

Meanwhile, the laundry machine according to one embodiment of the present invention includes a drum, a drive assembly for rotating the drum, and a suspension assembly for reducing the vibration of the drum.

The drive assembly includes a rotational shaft connected to the drum, a bearing housing rotatably supporting the rotational shaft, and a motor connected to the rotational shaft. In this case, the motor may be connected with the rotational shaft directly or indirectly.

The suspension assembly includes a radially extended bracket and a axially extended bracket.

The radially extended bracket could be a bracket extended from the bearing housing to the location spaced apart in a radius direction based on the rotational shaft. The axially extended bracket could be a bracket extended in an axial direction of the drum.

Meanwhile, the tub receiving the washing water may be provided fixedly, or may be supported through a flexible support structure such as the suspension assembly. Also, the tub may be supported at a middle level between the level supported by the suspension assembly and the level supported fixedly.

In other words, the tub may be supported flexibly at the same level as the suspension assembly, or may be supported more rigidly than the suspension assembly. For example, the tub may be supported by the suspension assembly, may be supported by a rubber bushing that can give flexibility to movement although not more flexible than the suspension assembly, or may be provided fixedly.

Examples of the tub supported more rigidly than the suspension assembly will be described in more detail.

First of all, at least a part of the tub may be formed in a single body with a cabinet. For example, the tub and the cabinet can be formed in a single body by injection molding. In more detail, a front portion of the tub and a front portion of the cabinet may be formed in a single body by injection molding.

Second, the tub may be supported by being connected to a screw, a rivet, or a rubber bushing, or may fixedly be supported by welding, adhesion sealing, or the like. In this case, such a connection member has rigidity greater than that of the suspension assembly for an up and down direction of the drum, which corresponds to a main vibration direction of the drum.

The aforementioned tub could be extended within the possible range of the space where it is provided. In other words, the tub can be extended in a way that it approaches a wall or frame (for example, left side or right side of the cabinet) that limits left and right sizes of the space, in at least left and right direction (direction horizontally crossing the shaft direction when the rotational shaft is placed horizontally). In this case, the tub may be formed at the left or right wall of the cabinet in a single body with the cabinet.

Relatively, the tub may be formed to be nearer to the wall or frame than the drum in the left and right direction. For example, the tub may be spaced apart from the wall or frame at an interval less than the interval with the drum by 1.5 times. In a state that the tub is extended in the left and right direction, the drum may also be extended in the left and right direction. And, if the left and right interval between the tub and the drum is small, the drum can be extended in the left and right direction as much as the left and right interval. In reducing the left and right interval between the tub and the drum, left and right vibration of the drum may be considered. If the left right vibration of the drum is small, a diameter of the drum can be more extended. Accordingly, a suspension unit that reduces the vibration of the drum can be formed with rigidity in a left and right direction, which is greater than rigidity in the other directions. For example, the suspension unit may be formed with maximum rigidity of displacement in a left and right direction, which is greater than that in the other directions.

Also, unlike the related art, the suspension assembly may directly be connected with the bearing housing that supports the rotational shaft connected with the drum, without through the tub.

At this time, the suspension assembly includes a bracket extended in the shaft direction of the rotational shaft, and the bracket may be extended towards the front where a door is placed.

Meanwhile, the suspension assembly includes two suspensions spaced apart from each other in the shaft direction of the rotations shaft.

Also, the suspension assembly may include a plurality of suspensions formed below the rotational shaft to standing-support their support object (for example, drum). Alternatively, the suspension assembly may include a plurality of suspensions formed above the rotational shaft to hang their support object up thereon. These cases correspond to the case where the suspensions are only provided below or above the rotational shaft.

The center of gravity of a vibration body that includes a drum, a rotational shaft, a bearing housing, and a motor can be directed towards the motor based on at least the center of a length direction of the drum.

At least one suspension may be placed at the front or rear of the center of gravity. Also, one suspension may respectively be placed before and after the center of gravity.

The tub may have an opening at the rear portion. A drive assembly that includes a rotational shaft, a bearing housing and a motor may be connected with the tub through a flexible member. The flexible member may be sealed to prevent the washing water from flowing out through the opening of the tub and allows relative movement of the drive assembly for the tub. This flexible member is formed of a flexible material that enables sealing, for example, a gasket material such as a front gasket. In this case, the flexible member may be referred to as a rear gasket corresponding to the front gasket. Connection of the drive assembly of the rear gasket can be made in a state that it is rotationally restrained for the rotational direction of the rotational shaft. For example, the rear gasket may directly be connected to the rotational shaft, or may be connected to an extension portion of the hearing housing.

Furthermore, a portion of the drive assembly, which is placed at the front of the connection portion with the rear gasket and can be exposed to the washing water within the tub, may be formed in a way that it is prevented from being corroded by the washing water. For example, the portion of the drive assembly may be coated, or may be surrounded with a separate part (for example, tub back) made of a plastic material. If a portion of the drive assembly, which is made of a metal material, is provided, the portion is not exposed to the water directly, whereby it can be prevented from being corroded.

Moreover, the laundry machine may not include the cabinet. For example, in case of a built-in laundry machine, instead of the cabinet, a space where the laundry machine will be provided may be prepared by a wall structure. In other words, the laundry machine may be made in a type that it does not include a cabinet constituting appearance independently. However, in this case, a front side may be required.

Advantageous Effects of Invention

According to the present invention, the laundry machine that condenses water through a natural cooling mode can be obtained. Also, if condensing is carried out by a forcible cooling mode, the laundry machine having an improved condensing rate can be obtained.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings.

MODE FOR THE INVENTION

Hereinafter, the preferred embodiments of the present invention will be described with reference to the accompanying drawings. Wherever possible, the same reference numbers will be used throughout the drawings to refer to the same or like parts.

Figure 1:
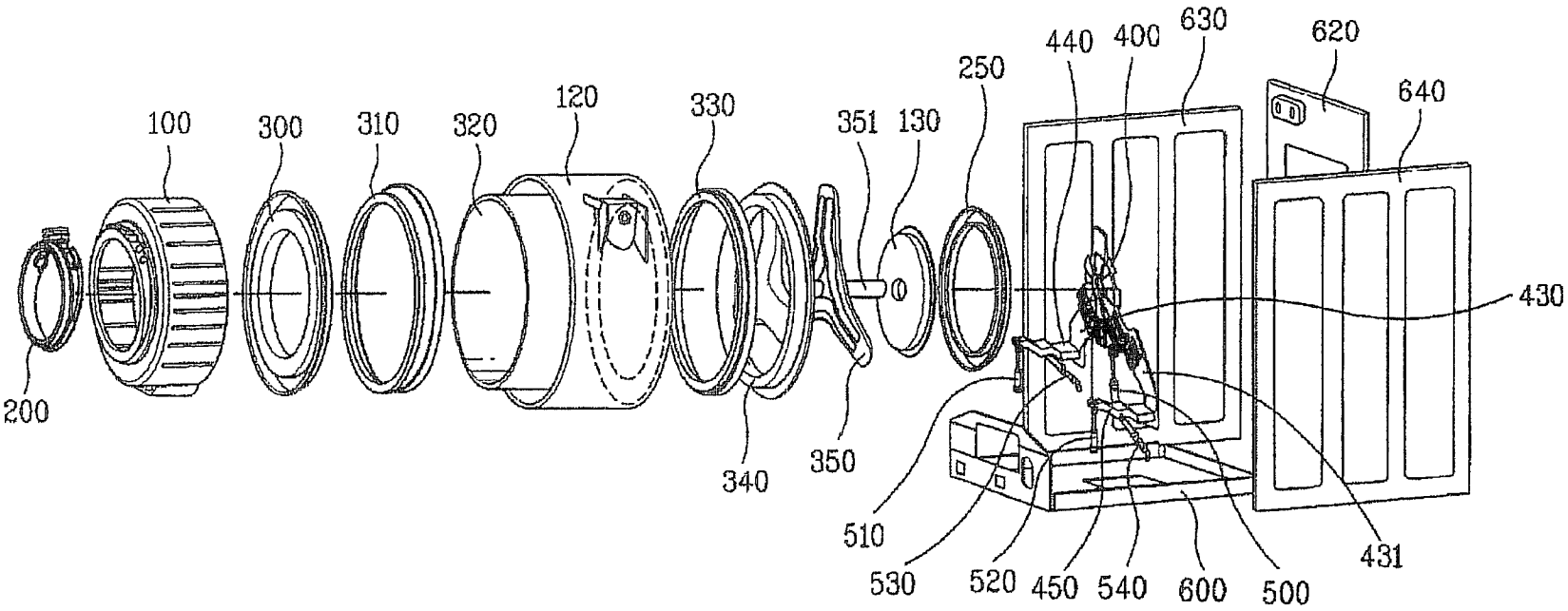
FIG. 1 is a partial assembly perspective view illustrating the first embodiment of the present invention.

FIG. 1 is a partial exploded perspective view illustrating a laundry machine according to the first embodiment of the present invention. FIG. 1 briefly illustrates a whole structure of the laundry machine according to the first embodiment of the present invention, and some parts may be omitted in FIG. 1. Also, the laundry machine of FIG. 1 is a laundry machine having a drying function, in which a drying function and a washing function are provided. In this embodiment, a condensing chamber is a tub.

In the laundry machine according to the first embodiment of the present invention, a tub is fixedly supported to a cabinet. The tub includes a tub front 100 constituting a front portion and a tub layer 120 constituting a rear portion.

The tub front 100 and the tub layer 120 can be assembled by a screw, and form a space therein to receive a drum. The tub layer 120 has an opening at the rear. The tub layer 120 is connected with a rear gasket 250 at a portion where the opening is formed, wherein the rear gasket 250 is a flexible member. The rear gasket 250 may be connected with a tub back 130 at an inner portion of a radius direction. The tub back 130 is provided with a through hole at the center, through which a rotational shaft passes. The rear gasket 250 is formed flexibly in such a manner that vibration of the tub back 130 is not transferred to the tub layer 120.

The rear gasket 250 is connected with the tub back 130 and the tub layer 120 and sealed, so that washing water in the tub does not leak out. The tub back 130 is vibrated together with a drum when the drum is rotated. At this time, the tub back 130 is spaced apart from the tub layer 120 at a sufficient interval so as not to interfere with the tub layer 120. Since the rear gasket 250 can be varied flexibly, it allows relative movement of the tub back 130 without interference with the tub layer 120. The rear gasket 250 can have a curved portion or folding portion 252 that can be extended at a sufficient length to allow such relative movement of the tub back 130.

The tub has an inlet at the front thereof to put laundry in and out. At the front potion of the tub, where the inlet is placed, a front gasket 200 may be provided to prevent washing water from leaking out through the inlet, prevent laundry or other foreign substances from flowing between the tub and the drum, or carry out other function.

The drum includes a drum front 300, a drum center 320, and a drum back 340. A ball balancer may be provided at the front and rear portions of the drum, respectively. The drum back 340 is connected with a spider 350. The spider 350 is connected with a rotational shaft 351. The drum is rotated within the tub by a rotational force transferred through the rotational shaft 351.

The rotational shaft 351 is connected with a motor through the tub back 130. In this embodiment, the motor is connected with the rotational shaft. In other words, in this embodiment, the motor is directly connected to the rotational shaft. In more detail, a rotor of the motor is directly connected with the rotational shaft 351. A bearing housing 400 is fixed to a rear surface 128 of the tub back 130. The bearing housing 400 rotatably supports the rotational shaft 351 between the motor and the tub back 130.

A stator 80 is fixedly provided in the bearing housing 400. The rotor is placed to surround the stator 80. As described above, the rotor is directly connected with the rotational shaft 351. The motor is an outer rotor type motor, and is directly connected with the rotational shaft 351.

The bearing housing 400 is supported from a cabinet base 600 through a suspension assembly. The suspension assembly can include a plurality of brackets connected with the bearing housing. The plurality of brackets can include radially extended brackets 430 and 431 extended in a radius direction and axially extended brackets 440 and 450 extended in a front and right direction or a rotational axis direction of the drum.

The suspension assembly can include a plurality of suspensions connected with the plurality of brackets.

In this embodiment, the suspensions include three vertical suspensions 500, 510 and 520 and two tilt suspensions 530 and 540 tilted for the front and rear direction. The suspension assembly is not fully fixed to the cabinet base 600 but connected with the cabinet base 600 to allow elastic deformation at a certain level, thereby allowing front and rear movement and left and right movement of the drum. In other words, the suspension assembly is elastically supported to allow rotation in a front and rear direction and a left and right direction for a point where the suspension assembly is connected to the base. The aforementioned suspensions vertically provided for elastic support may be provided in the base 600 using a rubber bushing. The vertical suspensions elastically absorb vibration of the drum while the tilt suspensions attenuate the vibration. In other words, in a vibration system that includes a spring and a damping means, the vertical suspensions serve as the spring while the tilt suspensions serve as the damping means.

The tub is fixed to the cabinet, and vibration of the drum is absorbed by the suspension assembly. A front portion and a rear portion of the tub can be fixed to the cabinet. The tub can be mounted on the base of the cabinet and then fixed to the base.

In the laundry machine according to this embodiment, the tub is substantially detached from the support structure of the drum. Also, the laundry machine according to this embodiment has a structure that the tub is not vibrated even though the drum is vibrated. In this case, the vibration amount of the drum, which is transferred to the tub, may be varied depending on the rear gasket.

Also, in the laundry machine according to this embodiment, since vibration of the tub is remarkably small, an interval maintained due to vibration is not required unlike the related art. Accordingly, an outer surface of the tub can be placed near the cabinet to the maximum range. This enables increase of the size of the tub even though the size of the cabinet is not increased, and enables increase of the capacity of the laundry machine in the size of the same appearance.

Substantially, an interval between a cabinet right 630 or a cabinet left 640 and the tub may be 5 mm only. In the laundry machine vibrated with a tub according to the related art, an interval between the tub and a cabinet is 30 mm so that vibration of the tub does not interfere with the cabinet. In this embodiment, a diameter of the tub can be more extended as much as 50 mm than that of the related art. This brings a remarkable difference that can increase the capacity of the laundry machine much more in the size of the same appearance.

Although not shown, the laundry machine may include a water supply valve connected with a tap to supply washing water to the tub. Also, the laundry machine may be provided with a detergent box to store detergent.

The water supply valve may be connected with the detergent box through a hose. The detergent box may be connected with the tub through a hose. In this case, if washing is carried out, the water supply valve is driven so that water is supplied from the tap to the tub through the detergent box.

Figure 2:
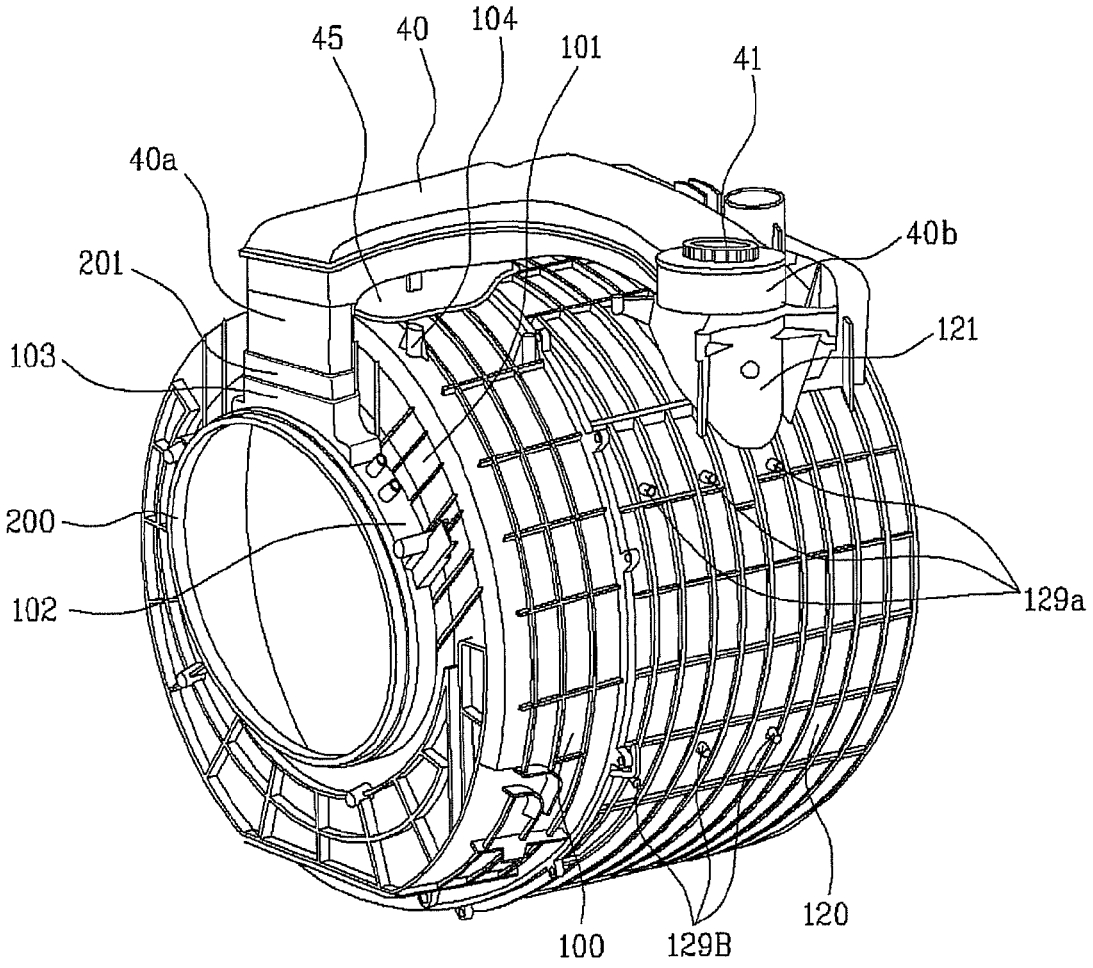
FIG. 2 is a diagram illustrating a tub and a drying module of the first embodiment.
Figure 3:
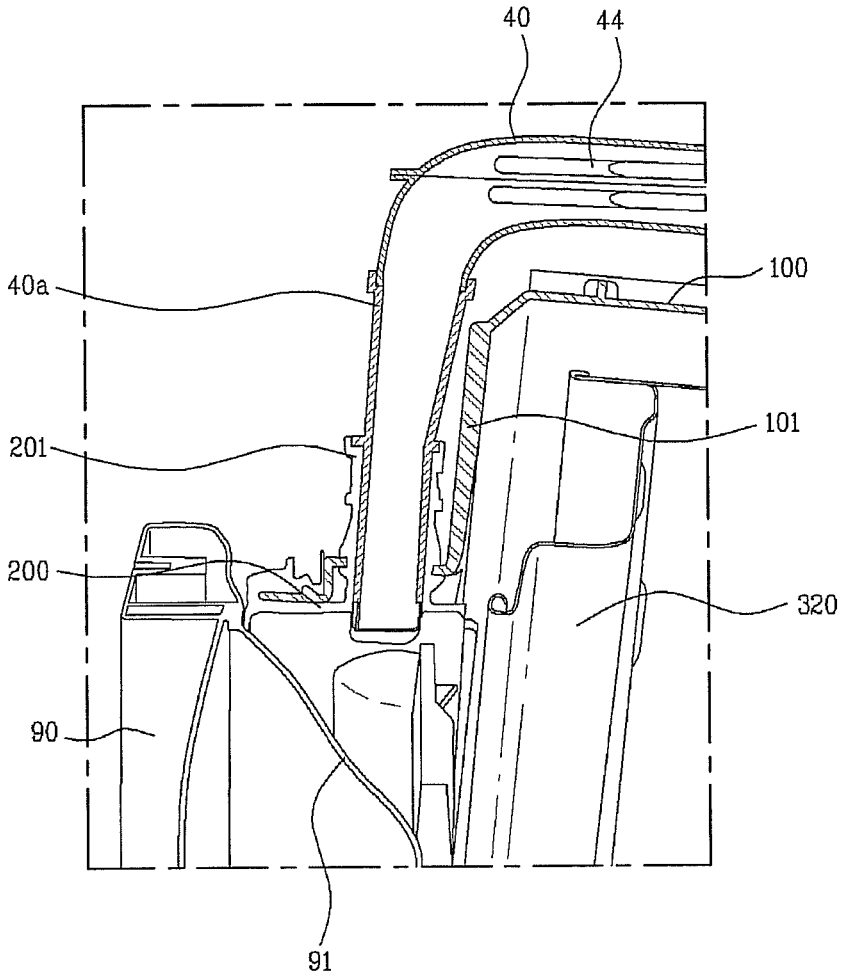
FIG. 3 is a partial sectional view illustrating a hot air inlet of the first embodiment.

Meanwhile, FIG. 2 is a diagram illustrating that a drying duct 40 is provided in the tub 100, 120, and FIG. 3 is a diagram illustrating a section of a top portion at the front of the tub 100, 120 connected with the drying duct 40.

First of all, the tub 100, 120 has a front portion 101 at the front, wherein the front portion 101 is placed prior to a discharge inlet of a drum 300, 320, 340. The front portion 101 is provided with a rim portion 102 projected towards the front, and a front gasket 200 is inserted into the front portion of the rim portion 102. The rim portion 102 is formed in such a manner that its upper portion is more projected towards the front than its lower portion.

A hot air inlet 103 for inflow of the hot air is formed at the upper portion of the rim portion 102. The hot air inlet 103 is upwardly projected from the upper portion of the rim portion 102. A projection angle of the hot air inlet 103 is within the range of 45 degree for a virtual plane where the discharge inlet of the drum 300, 320, 340 is placed. In this embodiment, the projection angle is within 10 degree and is parallel with the discharge inlet.

The drying duct 40 has both ends directly connected with tub 100, 120. The laundry machine of this embodiment does not include a condensing duct unlike the related art. Accordingly, the drying duct 40 is directly connected with the tub 100, 120. In other words, although a circulating passage of the hot air according to the related art is formed in the order of drying duct-tub-drum-tub-condensing duct-drying duct, a circulating passage is formed in the order of 'drying duct-drum-tub-drying duct' in this embodiment. Since the condensing duct exists at the circulating passage of the related art, the hot air flows between the tub 100, 120 and a sidewall of the drum 300, 320, 340, whereby the circulating passage is complicated and long. In more detail, according to the related art, the hot air flows towards the outer surface of the drum between the inner wall of the front portion of the tub and the outer surface of the front portion of the tub. Moreover, since the hot air flows between the sidewall of the tub and the drum, it is not effective in that a part of the hot air does not flow into the drum, stays within the tub, and then is discharged to the condensing duct. Also, if the circulating passage is complicated and long, heat loss may occur, and passage resistance may be increased.

In this embodiment, the drying duct includes a connection duct 40*a* inserted into the hot air inlet 103 and a scroll 40*b* connected with a hot air outlet 121 and provided with a fan 41 therein, wherein the hot air outlet 120 is formed in the tub 100, 120. A heater 44 is provided between the connection duct 30*a* and the scroll 40*b* of the drying duct 40.

The front gasket 200 fixed to the front portion of the rim portion 102 of the tub 100, 120 is provided with a duct connection portion 201 inserted into the hot air inlet 103, and seals the space between the connection duct 40*a* and the hot air inlet 103. The connection duct 40*a* is inserted into the duct connection portion 201 of the front gasket 200. The connection duct 40*a* is upwardly assembled with the drying duct 40 where the heater 44 is provided, and is downwardly assembled with the hot air inlet 103 through snug fit by interposing the duct connection portion 201 of the front gasket 200 therebetween.

As shown in FIG. 3, the hot air inlet 103 is placed at the front of the discharge inlet of the drum 300, 320, 340. A discharge outlet of the connection duct 40*a* inserted into the hot air inlet 103 is also placed at the front of the discharge inlet of the drum 300, 320, 340.

Meanwhile, as shown in FIG. 3, the discharge inlet of the tub 100, 120 is placed at the front of the hot air inlet 103. A door glass 91 of a door 90 that opens and closes the discharge inlet is downwardly tilted towards the drum 300, 320, 340. The door glass 91 is placed below the hot air inlet 103. The hot air discharged from the connection duct 40*a* downwardly strikes the door glass 91 and is switched to the inside of the drum 300, 320, 340. In other words, the upper portion of the door glass 91 assists the hot air discharged from the connection duct 40*a* to flow towards the inside of the drum 300, 320, 340.

In this embodiment, the hot air flows into the drum 300, 320, 340. According to the related art, the hot air flows between the front portion 101 of the tub 100, 120 and the front portion of the drum 300, 320, 340, and the hot air also flows to vertically strike the front portion of the drum 300, 320, 340. Accordingly, according to the related art, only 30% of the hot air flowing from the drying duct 40 flows into the drum 300, 320, 340. The other 70% of the hot air flows between the drum 300, 320, 340 and the tub 100, 120 and then is discharged to the condensing duct. For this reason, it is not efficient in that the hot air cannot be used for drying of laundry placed in the drum 300, 320, 340.

In this embodiment, the tub 100, 120 is tilted in such a manner that its front portion is higher than its rear portion. The front portion 101 of the tub 100, 120 is tilted at the same angle as that of tub based on a vertical line. The drum 300, 320, 340 is also tilted at a similar angle.

However, the discharge inlet of the tub 100, 120 is not tilted but is formed in parallel with the vertical line. This is achieved by more projecting the upper portion of the rim portion 102 of the tub 100, 120 towards the front. In other words, in order to form the discharge inlet parallel with the vertical line from the front portion 101 of the tub 100, 120 tilted at a predetermined angle based on the vertical line, the upper portion of the rim portion 102 is more projected towards the front.

As the tub 100, 120 is tilted as above, a predetermined space is obtained between the upper portion of the front portion 101 of the tub 100, 120 and the inner surface of the front side of the cabinet. The connection duct 40*a* is provided at the obtained space. Of course, unlike the aforementioned embodiment, the tub 100, 120 may not be tilted.

Also, in this embodiment, the tub 100, 120 is fixedly connected with the cabinet. In other words, tub 100, 120 is fixed to the cabinet. In this embodiment, since the tub 100, 120 is little vibrated in comparison with the drum 300, 320, 340, it can stably support the drying duct 40. In more detail, in this embodiment, the front portion 101 of the tub 100, 120 is fastened into a front plate (not shown) of the cabinet and the rear portion of the tub 100, 120 is fastened into a rear plate 620 of the cabinet by a screw or bolt. Also, the tub 100, 120 is provided on a bottom plate 600 of the cabinet in a self-standing type.

Referring to FIG. 2, the drying duct 40 is provided at the center of the upper portion of the tub 100, 120. One end of the drying duct 40 is inserted into the hot air inlet 103 by the connection duct 40*a*, and the other end thereof is laterally bent, so that the other end is connected with the hot air outlet 121 of the tub 100, 120 through the scroll 40*b* where the fan 41 is placed.

A heater 44 for generating the hot air is provided inside the front portion of the drying duct 40, which is placed above the tub 100, 120. The air ventilated by rotation of the fan 41 is heated by the heater 44.

The portion of the drying duct 40 where the heater 44 is placed may be maintained at a high temperature due to heat of the heater 44. Accordingly, an insulating plate 45 is placed between the portion of the heater 44 of the drying duct 40 and the tub 100, 120.

The drying duct 40 is fixedly provided above the tub 100, 120. In this embodiment, the drying duct 40 is fastened to the tub 100, 120 by a screw.

Meanwhile, as shown in FIG. 2, the hot air outlet 121 is formed at a side portion (right side portion in this embodiment) of the upper portion of the circumferential surface of the tub 100, 120. The scroll 40*b* of the drying duct 40 is provided above the hot air outlet 121. The fan 41 placed inside the scroll 40*b* ventilates the hot air into the drying duct 40 by inhaling the hot air from the hot air outlet 121. The fan 41 ventilates the hot air in a radius direction by inhaling the hot air in a rotational direction based on the rotational shaft. Namely, in this embodiment, a centrifugal fan is used.

The direction of the hot air discharged from the hot air outlet 121 is the same as an inhale direction of the hot air inhaled by the fan 41. This structure contributes to more preferable circulation of the hot air. The hot air discharged from the inside of the tub 100, 120 through the hot air outlet 121 flows into the fan 41 in the discharged direction and then is ventilated to the drying duct 40.

The hot air inlet 103 and the hot air outlet 121 are placed above the tub 100, 120. The hot air inlet 103 is placed at the front portion, and the hot air outlet 121 is placed at the rear portion. Also, an angle between flow lines of the hot air of the hot air inlet 103 and the hot air outlet 121 is within 10 degree based on the vertical line. An angle between the flow lines of the hot air inlet 103 and the hot air outlet 121 is within 10 degree. In this embodiment, the flow lines of the hot air of the hot air inlet 103 and the hot air outlet 121 are parallel with each other and their directions are contrary to each other.

The hot air inlet 103 and the hot air outlet 121 are connected with each other by the drying duct 40 placed above the tub 100, 120. Accordingly, the hot air flows along a simple circulating passage of 'drying duct-tub-drying duct.' Since the inside of the tub 100, 120 is relatively wide, passage resistance may be small relatively. In this embodiment, passage resistance may mainly occur in the drying duct 40. In this respect, in the laundry machine according to the related art, in addition to complexity of the passage due to the condensing duct, since the condensing duct is additionally provided, the length of the passage of the duct becomes long, whereby high passage resistance occurs.

Figure 4:
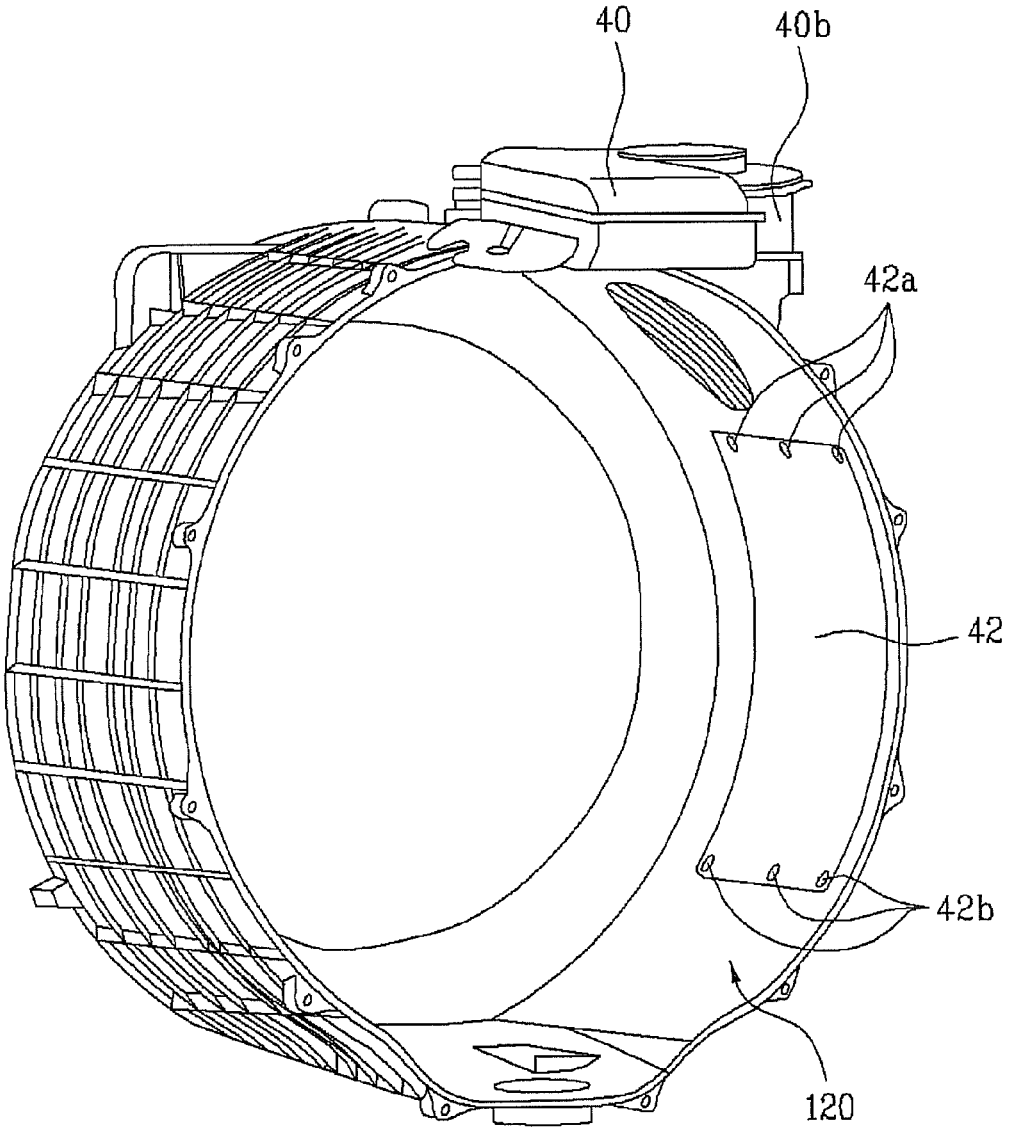
FIG. 4 is a diagram illustrating the inside of the tub.

Meanwhile, FIG. 4 illustrates the inside of the tub. As shown in FIG. 4, a condensing plate 42 is provided along the inner circumference of the tub 100, 120. In this case, the condensing plate 42 may be formed of a metal material. Although the tub 100, 120 may be formed of a metal material, it can be formed of a plastic material by injection molding. If the tub 100, 120 is made of a plastic material, the condensing plate 42 of a metal material cooler than the plastic material is preferably mounted inside the tub 100, 120 to easily carry out condensing.

For arrangement of the condensing plate 42, three fastening bosses 129*a* and 129*b* are respectively formed at the upper portion and the lower portion of the tub 100, 120 as shown in FIG. 2. The fastening bosses are formed in a way that a screw is fastened inside the tub 100, 120. If the condensing plate 42 placed inside the tub 100, 120 is fixed by tightening a screw outside the tub 100, 120, a fastening hole formed for screw fastening should be sealed. However, if the fastening bosses are formed to fasten the screw inside the tub 100, 120 as described in this embodiment, no sealing is required. In other words, although the fastening bosses 129*a* and 129*b* are formed inside the tub 100, 120 to be projected from the outer circumference of the tub 100, 120, they do not pass through the outer circumference of the tub 100, 120.

The condensing plate 42 is placed at the center of the side portion of the inner circumference of the tub 100, 120. The aforementioned fastening bosses 129*a* and 129*b* are fastened using screws 42*a* and 42*b*. Referring to FIG. 4, the condensing plate 42 is placed at the center of the right inner circumference where the hot air outlet 121 is placed when the inner circumference of the tub 100, 120 is divided into an upper, a lower, a left, and a right portions. In view of the hot air outlet 121, the condensing plate 42 is placed at the inner circumference below the hot air outlet 121 of the inner circumference of the tub 100, 120. Accordingly, the hot air containing water while passing through the drum 300, 320, 340 is condensed in contact with the condensing plate 42 placed at the inner circumference of the tub 100, 120 before being discharged outside the tub 100, 120 through the hot air outlet 121. In this case, condensing may occur at another inner circumference of the tub 100, 120. Since the condensing plate 42 is made of a metal material, condensing may occur more effectively than the condensing plate 42. The condensing plate 42 may be made of a stainless steel material.

Figure 5:
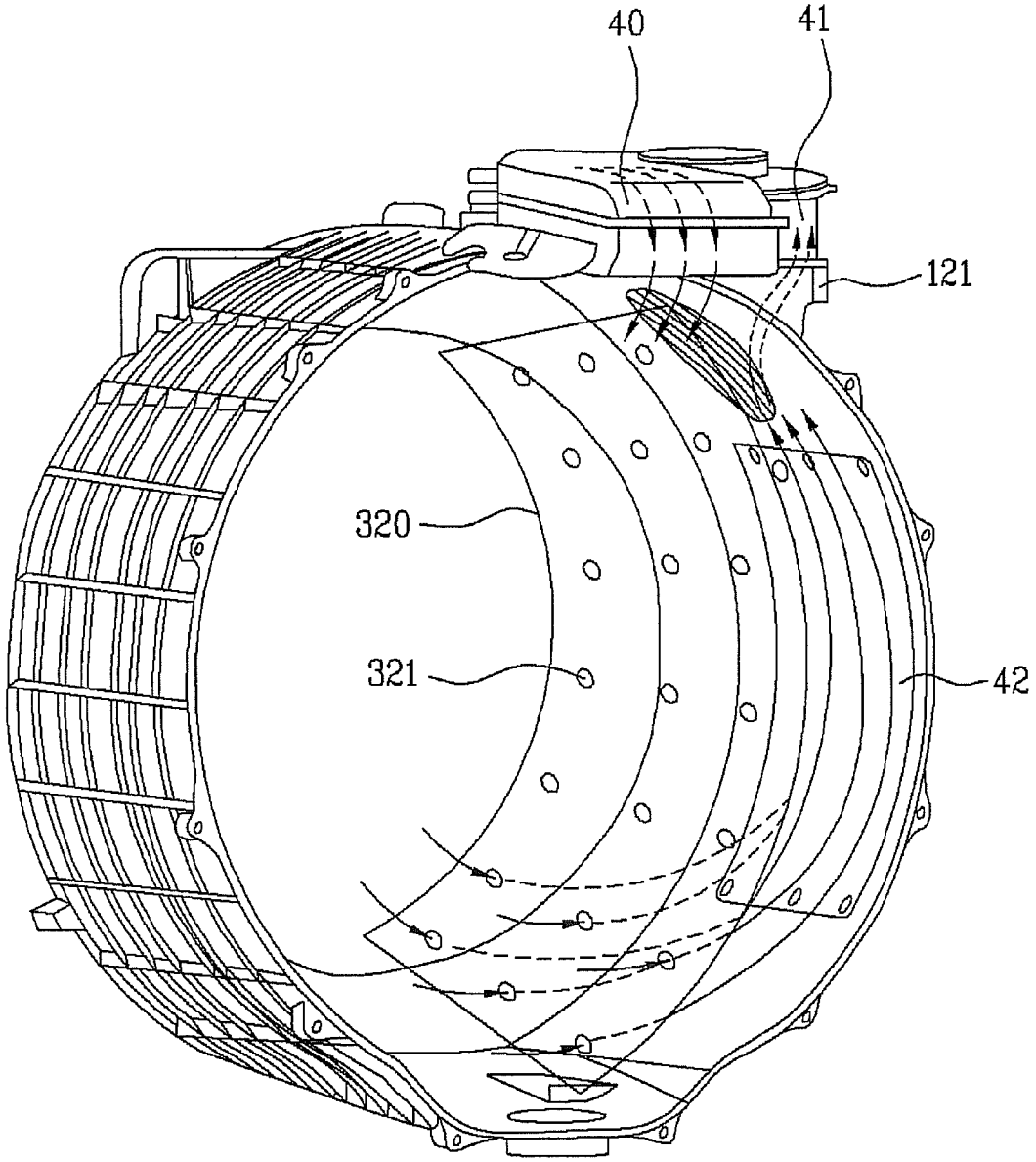
FIG. 5 is a diagram illustrating a circulating passage of the hot air.

FIG. 5 is a diagram illustrating a circulating passage of the hot air during drying in the aforementioned laundry machine having a drying function. First of all, the hot air can be generated by the heater 44 inside the drying duct 40 and the fan 41 placed inside the scroll 40*b*. The air ventilated by the fan 41 is heated at a high temperature by the heater 44 and then flows. The hot air flows into the front of the drum 300, 320, 340 through the connection duct 40 inserted into the hot air inlet 103 of the tub 100, 120 and then flows into the drum through the discharge inlet of the drum.

The hot air flown into the drum 300, 320, 340 is discharged inside the drum 300, 320, 340 through a through hole 321 formed at the sidewall of the drum 300, 320, 340 in a state that it becomes wet in contact with wet laundry. The wet air flown out between the drum 300, 320, 340 and the tub 100, 120 through the through hole 321 is discharged from the tub 100, 120 through the hot air outlet 121 placed at the rear portion of the tub layer 120 while flowing between the tub 100, 120 and the drum 300, 320, 340. In this way, the air discharged through the hot air outlet 121 is circulated in a way that it is inhaled by the fan 41 and again ventilated into the drying duct 40.

In this case, before being discharged through the hot air outlet 121, water contained in the wet air is condensed while the wet air flows between the tub 100, 120 and the drum 300, 320, 340. For useful condensing, heat should be removed from the wet air. The heat is discharged to the outside of the tub 100, 120 by natural convection in contact with the air around the outer surface of the tub 100, 120. In this way, heat is removed from the wet air between the tub 100, 120 and the drum 300, 320, 340 by natural convection through the outer surface of the tub 100, 120, and the water contained in the wet air is condensed.

At this time, water droplets will be formed on the surface of the condensing plate 42 and inside the tub 100, 120 due to condensing. The condensing plate 42 may not be required necessarily for natural cooling as above. Although the condensing plate 42 may assist in increasing a condensing rate, the water can be condensed inside the tub 100, 120 and the required condensing rate can be obtained even without the condensing plate 42. A laundry machine having no condensing plate 42 according to another embodiment of the present invention will be described later.

The laundry machine of this embodiment includes a circulating drying system that circulates the hot air. No separate condensing duct is provided, and the space between the drum 300, 320, 340 and the tub 100, 120 serves as a condensing chamber.

The space between the drum 300, 320, 340 and the tub 100, 120 may have a temperature lower than that of the inside of the drum 300, 320, 340. Since the tub 100, 120 is in contact with the outside cold air, condensing may occur at the sidewall of the tub 100, 120 or the condensing plate 42.

Figure 6:
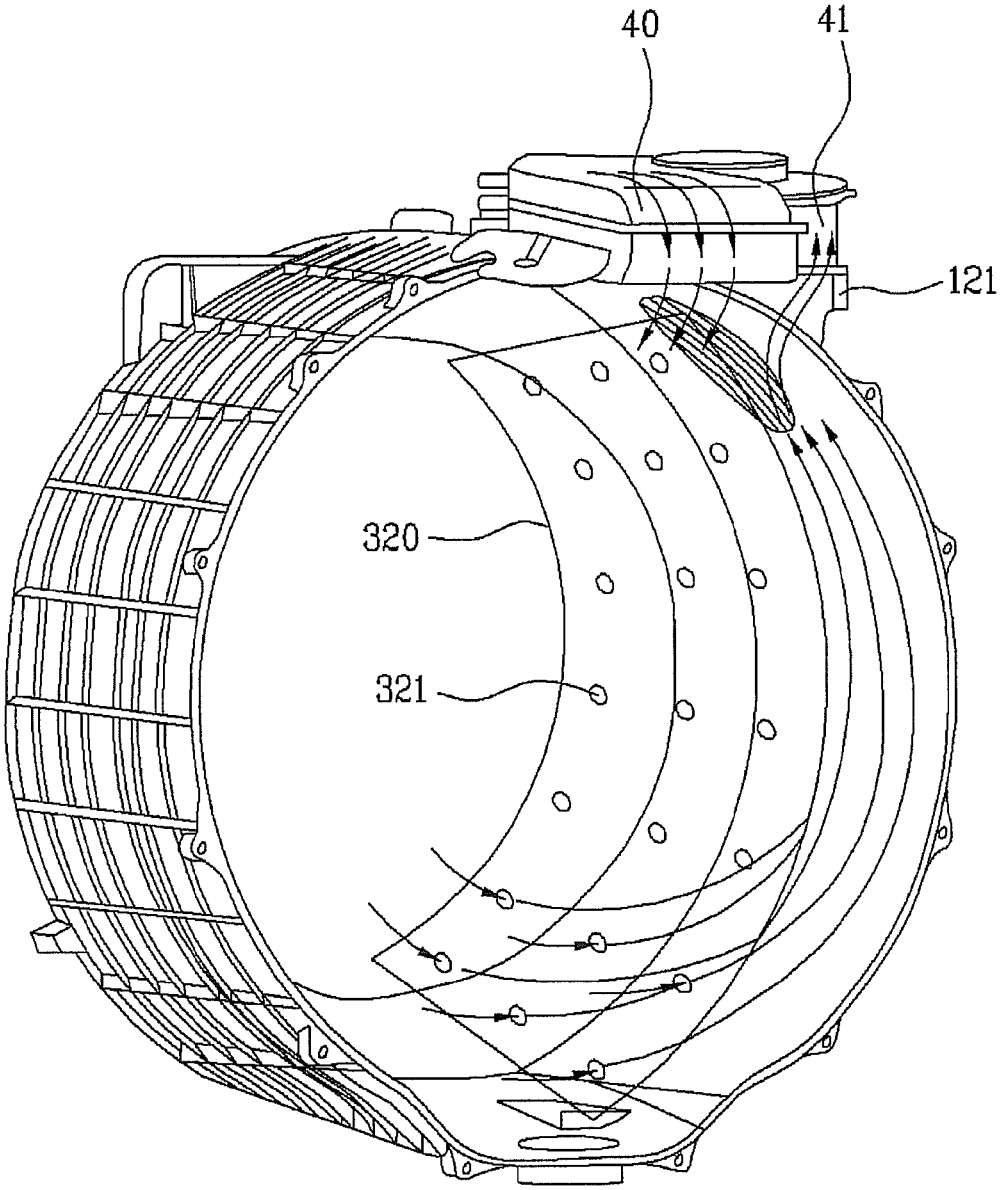
FIG. 6 is a diagram illustrating the second embodiment of the present invention.

FIG. 6 illustrates that the condensing plate 42 is not placed inside the tub 100, 120 as described above. The outer surface of the tub 100, 120 exchanges heat with the outside air through natural convection. The wet air discharged from the drum 300, 320, 340 is in contact with the inner surface of the tub 100, 120, wherein the inner surface has a low temperature. The water contained in the wet air is condensed. The embodiment of FIG. 6 is the same as the aforementioned embodiment except that the condensing plate 42 is not used. Accordingly, additional description will be omitted.

Figure 7:
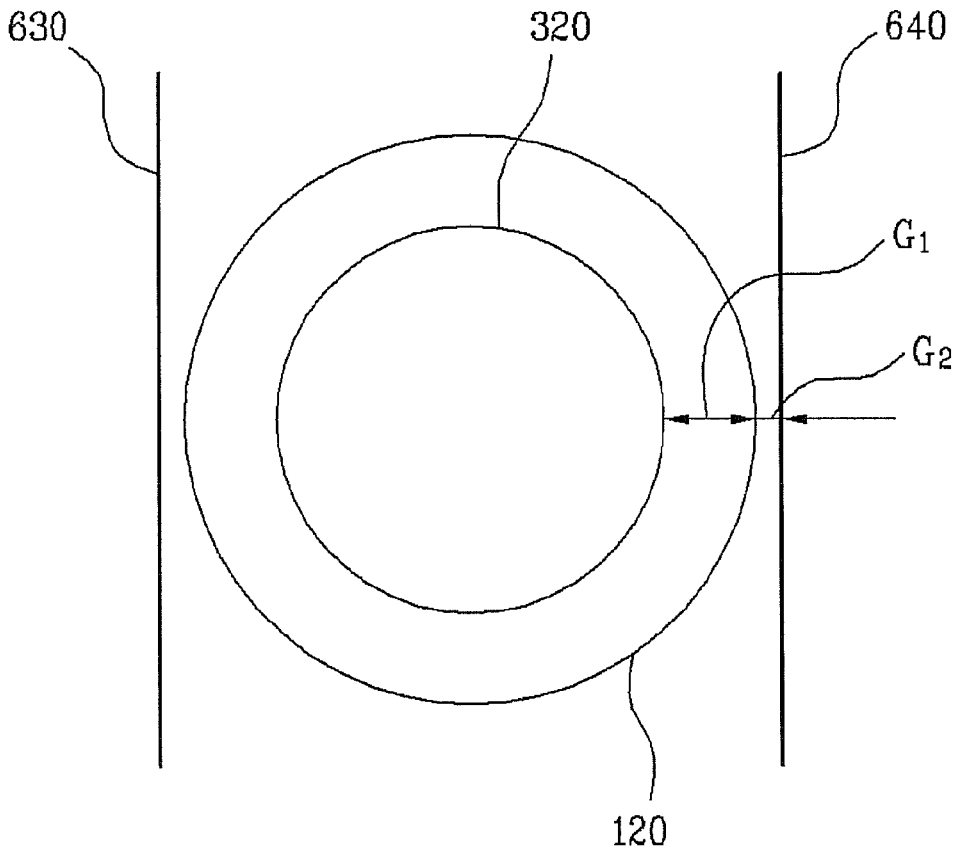
FIG. 7 is a diagram illustrating the relation of an interval among a tub, a drum, and a cabinet according to the first embodiment or the second embodiment of the present invention.

Meanwhile, in the aforementioned laundry machine, the outer surface of the tub 100, 120 may be formed near the inner surface of the cabinet. Referring to FIG. 7, an interval G2 between the tub 100, 120 and the left or right side of the cabinet based on a horizontal line passing through the center point inside the tub 300, 320, 340 is smaller than an interval G1 between the tub 100, 120 and the drum 300, 320, 340. If the outer surface of the tub 100, 120 is placed near the inner surface of the cabinet, heat discharge by the cold air outside the cabinet may be effective. In other words, the outer surface of the tub 100, 120 is cooled by natural convection in contact with the air inside the cabinet, and the air inside the cabinet is cooled through the outside cold air outside the cabinet. Accordingly, if the outer surface of the tub 100, 120 is placed near the cabinet, heat discharge may be effective.

In the aforementioned embodiments, since vibration of the tub 100, 120 is smaller than that of the drum 300, 320, 340, it can be placed near the inner surface of the cabinet. Also, the tub 100, 120 may be fixed to the cabinet as described above.

Furthermore, in the aforementioned laundry machine, the temperature inside the drum 300, 320, 340 is higher than that between the drum 300, 320, 340 and the tub 100, 120. The inside of the drum 300, 320, 340 could be a drying space where drying of laundry is carried out. The space between the drum 300, 320, 340 and the tub 100, 120 could be a condensing chamber where condensing is carried out. For effective condensing, it is preferable that the condensing chamber has a temperature lower than that of the drying space.

For example, the inner temperature of the tub 100, 120 may be lower than that of the drum 300, 320, 340. At the upper portion of the tub 100, 120, the portion near the heater 44 placed inside the drying duct 40 may have a temperature higher than that of the other portions. However, considering the inner temperature at the lower portion of the tub 100, 120, the portion may have a temperature lower than the inner temperature of the drum 300, 320, 340.

Figure 8:
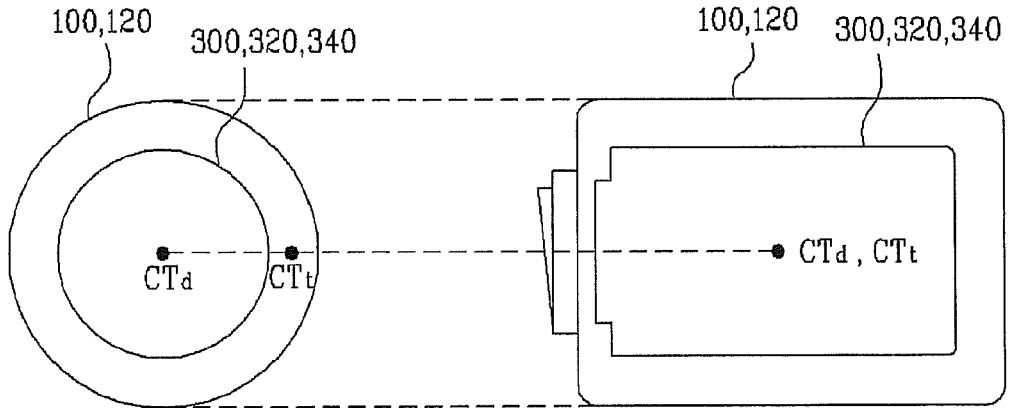
FIG. 8 is a diagram illustrating specific points CTt and CTd inside the tub and the drum.

Also, a temperature will be described in view of the space. The temperature of the center point inside the drum 300, 320, 340 is higher than that of the center point between the drum 300, 320, 340 and the tub 100, 120. More specifically, as shown in FIG. 8, the temperature of the center point CTd inside the drum 300, 320, 340 is higher than that of the center point CTt between the tub 100, 120 and the drum 300, 320, 340, wherein the center point CTt crosses the horizontal line extended from the center point inside the drum 300, 320, 340.

Figure 9:
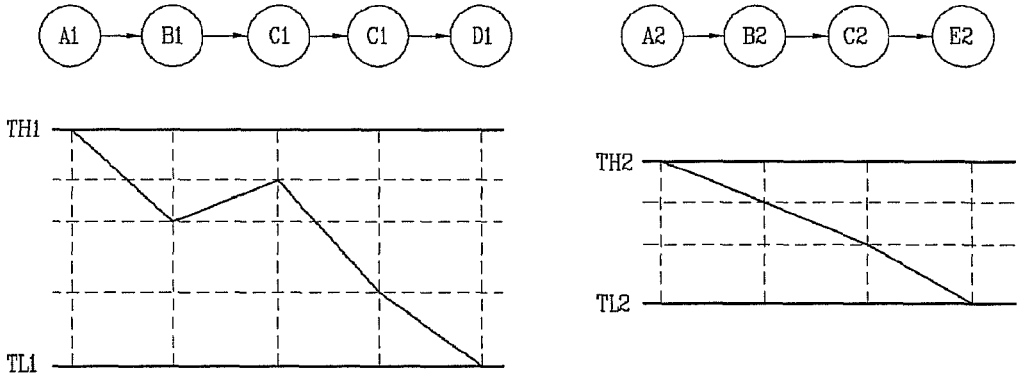
FIG. 9 is a diagram illustrating a temperature according to a circulating passage of the related art and the second embodiment.

Meanwhile, the temperature per location of the circulating passage of the hot air will be described with reference to FIG. 9. A graph at the left side of FIG. 9 is directed to the laundry machine having a drying function according to the related art while a graph at the right side of FIG. 9 is directed to the laundry machine according to this embodiment. In the laundry machine having a drying function according to the related art, the condensing duct is placed at the rear of the tub 100, 120, and cooling water flows into the condensing duct.

First of all, the left side of FIG. 9 illustrates temperature gradient for an inner temperature A1 of the connection duct 40*a*, an inner temperature B1 of the drum 300, 320, 340, a temperature C1 between the tub 100, 120 and the drum 300, 320, 340 at the lower portion of the tub 100, 120, an inlet temperature D1 of the condensing duct, and a temperature E1 before the air flows into the fan 41 after passing through the condensing duct.

And, the right side of FIG. 9 illustrates temperature gradient for an inner temperature A2 of the connection duct 40*a*, an inner temperature B2 of the drum 300, 320, 340, a temperature C2 between the tub 100, 120 and the drum 300, 320, 340 at the lower portion of the tub 100, 120, and a temperature E2 inside the hot air outlet 121 of the tub 100, 120. In this embodiment, since no condensing duct is provided, there is no temperature corresponding to the inlet temperature D1 of the condensing duct.

As shown, in the laundry machine according to the related art, a portion where a temperature increases exists at a passage of the hot air except for the portion where the heater 44 and the fan 41 are placed. In more detail, the inner temperature B1 of the drum 300, 320, 340 is higher than the temperature C1 between the tub 100, 120 and the drum 300, 320, 340. Accordingly, in the laundry machine according to the related art, it is not effective that the space between the tub 100, 120 and the drum 300, 320, 340 is used as the condensing space. In particular, it is difficult to achieve natural cooling inside the tub 100, 120. Also, it is not effective in that the wet air to be cooled for condensing is discharged from the drum 300, 320, 340 and then heated between the drum 100, 120 and the drum 300, 320, 340. On the other hand, in the laundry machine according to this embodiment, since no portion where a temperature increases exists at the passage of the hot air except for the portion where the heater 44 and the fan 41 are placed, the temperature continues to decrease. In particular, the temperature between the tub 100, 120 and the drum 300, 320, 340 is lower than the inner temperature of the drum 300, 320, 340.

Furthermore, in the laundry machine according to the related art, a high temperature difference occurs between the minimum temperature and the maximum temperature on the circulating passage. This can easily be noted from that a high temperature difference occurs between TH1 corresponding to the inner temperature A1 of the connection duct 40*a* and TL1 corresponding to the temperature E1 before the air flows into the fan 41 by passing through the condensing duct. This is because that the cooling water is supplied to the condensing duct to carry out forcible cooling. According to the laundry machine of the related art, since a flow rate is small if forcible cooling is not carried out, it is difficult to obtain the required drying rate. In this case, too much drying time may be required.

On the other hand, in the laundry machine according to this embodiment, a temperature difference TH1 corresponding to the inner temperature A2 of the connection duct 40*a* and TL1 corresponding to the inner temperature E2 of the hot air outlet 121 of the tub 100, 120 is relatively low.

Moreover, TH2 is lower than TH1. As a result, the maximum temperature on the circulating passage of the laundry machine according to this embodiment may be lower than that of the laundry machine according to the related art. This means that the system temperature of the laundry machine according to this embodiment is lower than that of the laundry machine according to the related art. Since higher heat loss to the outside may occur if the system temperature is high, it is not effective in view of energy.

Also, TL2 of this embodiment is higher than TL1 of the related art. This is because that a forcible cooling means such as cooling water is used in the laundry machine according to the related art. In this case, if condensing is carried out by the forcible cooling means, supercooling may occur when considering the amount of water contained in the hot air. In other words, considering the amount of water contained in the hot air, even the temperature (TL1; referred to as 'proper cooling temperature') higher than TL1 can be sufficient for the condensing rate. In this case, the difference between TL1 and the proper cooling temperature TL1 causes an inefficient result such as supercooling of the hot air. On the other hand, if cooling is carried out to reach the proper cooling temperature TL1 considering the amount of water contained in the hot air, there is no waste of energy due to supercooling. Since natural cooling does not accompany forcible cooling, waste of energy due to supercooling can be reduced.

In the laundry machine according to the related art, which uses forcible cooling, the difference between the temperature at the hot air inlet 103 and the temperature inside the scroll 40*b*, which is regarded as the temperature of the hot air passed through the condensing duct, is more than 40 degree. Even if natural cooling is carried out instead of forcible cooling, the temperature difference is less than 30 degree. If the amount of the hot air is more increased, the above temperature difference can be lowered to 20.about.22 degree. The flow rate of 1.5 m.sup.3/min may be suitable for the temperature difference of 30 degree while the flow rate of 1.77 m.sup.3/min may be suitable for the temperature difference of 20.about.22 degree.

Furthermore, in the laundry machines of the related art, which use forcible cooling, the temperature inside the scroll 40*b* may be lowered to 80 degree or less. However, if natural cooling is used, the temperature may be 90 degree or more. Although there may be a little difference depending on the condition, the temperature inside the scroll 40*b* is 98 degree or so in the laundry machine according to this embodiment.

Also, in the laundry machine of the related art, if cooling water is injected into the condensing duct, a problem occurs in that particles of the cooling water flow into the drum 300, 320, 340 through the drying duct 40. In this case, it is not effective in that the water is supplied to the object to be dried.

Meanwhile, the flow rate will be described. Examples of the method for increasing the flow rate include a method for increasing an input power applied to the fan 41 and a method for reducing passage resistance of the circulating passage.

Figure 10:
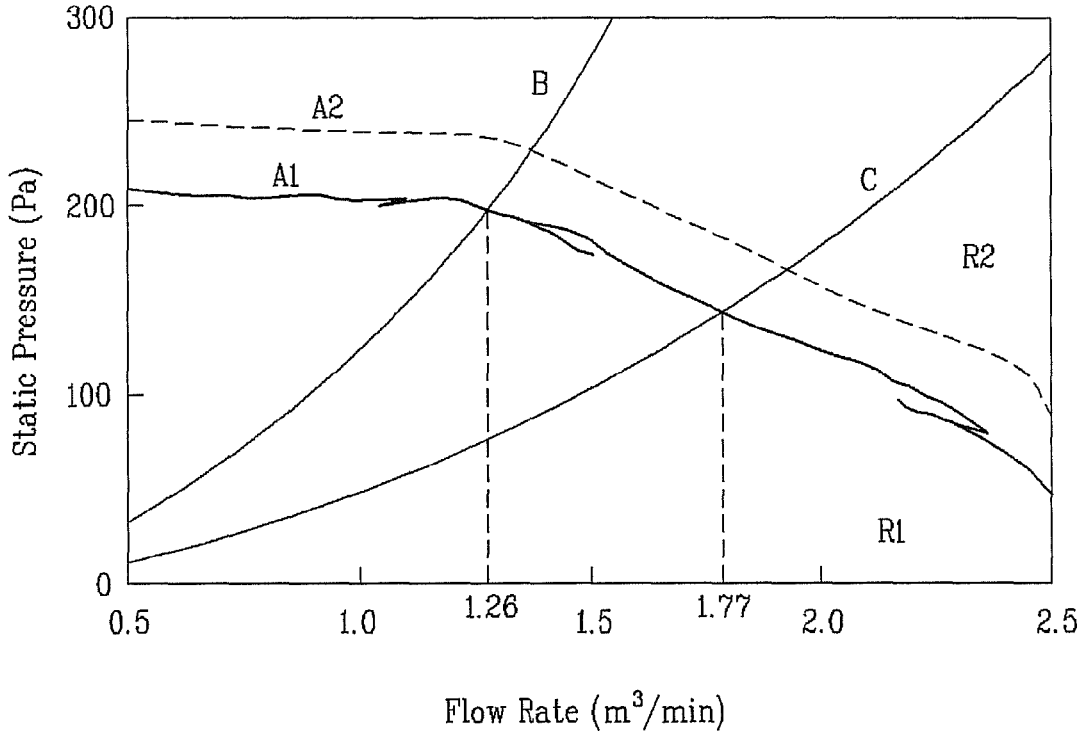
FIG. 10 is a diagram illustrating the relation between resistance of a circulating passage and a flow rate according to the related art and the second embodiment.

FIG. 10 is a diagram illustrating the relation between static pressure of a circulating passage and a flow rate according to the related art and the second embodiment. In this case, the flow rate is the volume of the air per hour. If the static pressure of the circulating passage is high, it means that the passage resistance is high.

In FIG. 10, a line marked with A1 denotes flow rate-static pressure properties of the fan 41 and the scroll 40*b*. This can be obtained through a wind tunnel test. In this case, the line graph is obtained in a way that the static pressure is varied for the wind tunnel in a state that the fan 41 is placed at the wind tunnel together with the scroll 40*b* and a certain input power is applied to the fan 41.

Line graphs marked with B and C represent static pressure according to a flow rate obtained by a test for the circulating passage except for the portion corresponding to the fan 41 and the scroll 40*b*. In this case, B is directed to the laundry machine of the related art while C is directed to the laundry machine of this embodiment.

The fan 41 and the scroll 40 or re the same as those of the laundry machines for B and C.

In order to obtain the line graphs such as B and C, after the portion of the fan 41 and the scroll 40*b* is removed from the circulating passage of each laundry machine, the circulating passage at the removed end is exposed to the air and maintained at an atmospheric pressure while the circulating passage at the other end is maintained at a pressure less than the atmospheric pressure. Flow rate data for the pressure difference between the atmospheric pressure and the pressure less than the atmospheric pressure are obtained.

A point where the line graph A1 meets the line graph B or C corresponds to the maximum flow rate that can be obtained by the corresponding laundry machine. It is supposed that the power applied to the fan 41 is the power applied when A1 is obtained.

As described above, examples of the method for increasing a flow rate include the method for increasing the power applied to the fan 41 and a method for reducing passage resistance of the circulating passage. The method for increasing a flow rate will be described in more detail.

First of all, if the input power increases for the fan 41 and the scroll 40*b*, the line graph of A1 will move to the line graph of A2. A point where A2 meets B or C will be the increased flow rate of each laundry machine.

On the other hand, in a state that A1 is maintained as it is, i.e., in a state that the input voltage applied to the fan 41 and the scroll 40*b* is maintained equally, if the passage resistance of the circulating passage is reduced, the line graph for flow rate-static pressure of the corresponding laundry machine will move from B to C.

However, as shown in FIG. 10, it is noted that the method for reducing passage resistance of the circulating passage is more effective than the method for increasing the input power. Also, the applied power may be limited by the power supplied to home and power consumption of other home appliances.

Accordingly, the method for reducing passage resistance of the circulating passage is regarded as the effective method for increasing a flow rate. The inventor of the present invention has studied to reduce passage resistance by varying the circulating passage through the above experimental study. As a result, the laundry machine according to this embodiment has been obtained.

As shown in FIG. 10, in the laundry machine according to the related art, high passage resistance occurs for the fan 41 and the scroll 40*b*, whereby a flow rate of maximum 1.26 m.sup.3/min is obtained. However in this embodiment, a flow rate more than 1.5 m.sup.3/min, i.e., a flow rate of 1.77 m.sup.3/min corresponding to 1.59.about.1.95 m.sup.3/min can be obtained.

In this embodiment, no condensing duct is provided. Accordingly, the circulating passage of this embodiment is shorter or simpler than that of the related art. Also, in the laundry machine according to the related art, a problem occurs in that the condensing duct serves as a bottleneck point on the circulating passage due to a narrow width and thus causes high passage resistance. However, in this embodiment, the problem is solved.

Also, in this embodiment, the passage for supplying the hot air to the drum 300, 320, 340 is different from that of the related art. As described above, in this embodiment, the hot air smoothly flows into the drum 300, 320, 340. Also, the direction of the hot air discharged from the tub 100, 120 is the same as that of the hot air flowing into the fan 41. In this embodiment, considering the passage of the drying duct 40 placed above the tub 100, 120 and the passage of the tub 100, 120, the drying duct 40 and the tub 100, 120 forms a substantially '.quadrature.' shaped simple circulating passage. The '.quadrature.' shaped simple circulating passage is obtained except that the drying duct 40 formed by extending the center at the upper portion of the tub 100, 120 from the front to the rear is bent to the right for arrangement of the fan 41. Viewed from the side, the circulating passage connected between the drying duct 40 and the tub 100, 120 has a simple passage close to '.quadrature.' shape. An angle between flow lines of the hot air of the hot air inlet 103 and the hot air outlet 121 is within 10 degree. In this embodiment, the flow lines of the hot air of the hot air inlet 103 and the hot air outlet 121 are almost parallel with each other. This shape of the hot air inlet 103 and the hot air outlet 121 contributes to simplifying the circulating passage.

In other words, in this embodiment, the short and simple circulating passage is obtained to remarkably reduce passage resistance, whereby the flow rate can be increased as much as 40% or more than that of the related art. Also, since passage resistance is small, energy loss due to passage resistance is also small.

Figure 11:
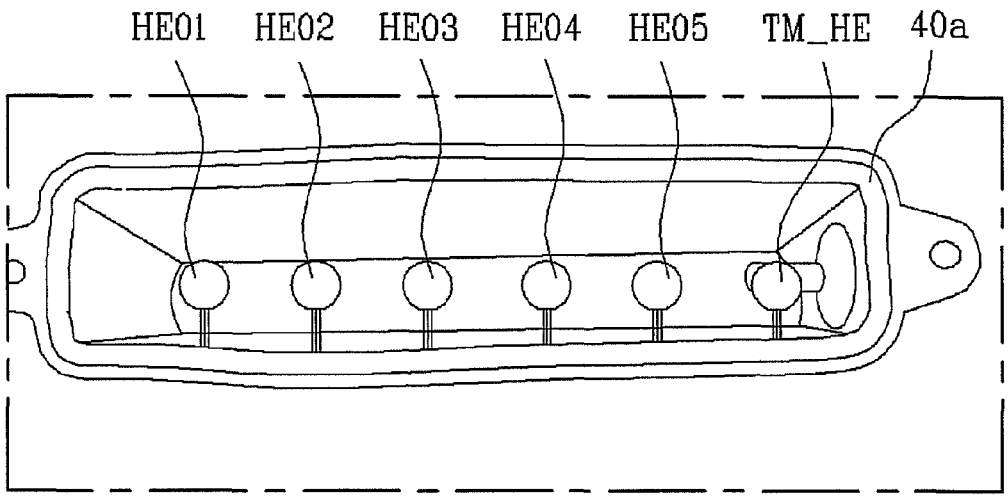
FIG. 11 is a diagram illustrating the inside of a connection duct.
Figure 12:
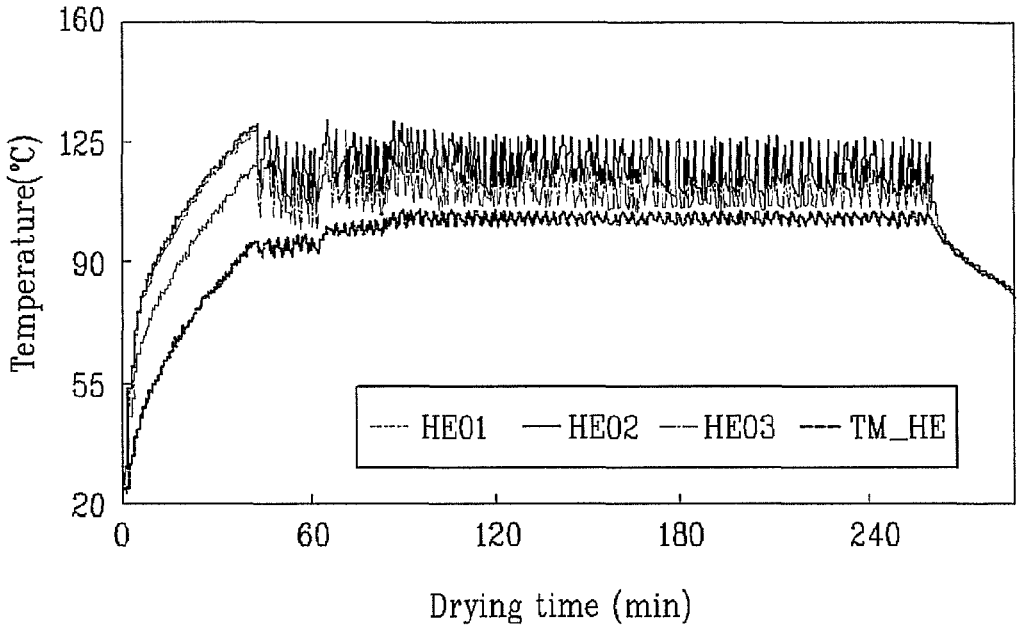
FIG. 12 is a diagram illustrating a temperature per location at a hot air inlet inside the connection duct of FIG. 11.
Figure 13:
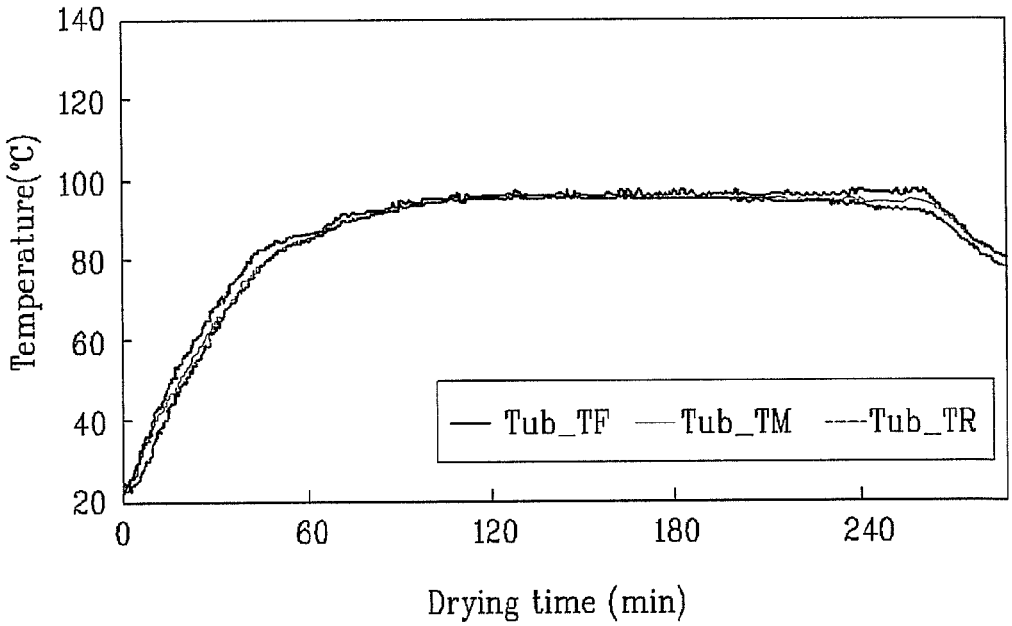
FIG. 13 is a diagram illustrating a surface temperature of a top portion of the tub according to the second embodiment.

Meanwhile, if the flow rate is increased as above, the temperature of the hot air may be lowered when the heater 44 emits the same heat. If the temperature of the hot air is lowered, the temperature of the laundry machine may be lowered. For example, the maximum temperature on the surface of the tub 100, 120 may be lowered to 140 degree or less. In this embodiment, the maximum temperature on the surface of the tub 100, 120 is less than 110 as shown in FIG. 13. FIG. 13 illustrates temperatures for the front, center, and rear of the center portion based on a left and right direction at the upper portion of the tub 100, 120. In this case, the maximum temperature of the hot air inlet 103 may be reduced to 160 degree or less. In this embodiment, the maximum temperature of the hot air inlet 103 is less than 140 degree. The average temperature according to location for the hot air inlet 103 may be lowered to 140 degree or less. In this embodiment, the average temperature is less than 120 degree. Also, the temperature difference according to the location of the hot air inlet 103 may be lowered to maximum 65 degree or less. In this embodiment, the temperature difference is less than 40 degree. In respect of the hot air inlet 103, the aforementioned temperatures can be obtained by measuring the temperature at the portion corresponding to the hot air inlet 103 inside the connection duct 40*a* as shown in FIG. 11. FIG. 12 illustrates a temperature of the hot air inlet 103 according to this embodiment, which is measured at the location of FIG. 11.

If the system temperature is lowered as the hot air increases as above, energy loss to the outside can be reduced. Heat discharged from the hot air before flowing into the drum 300, 320, 340 to the outside can be regarded as energy loss.

Figure 14:
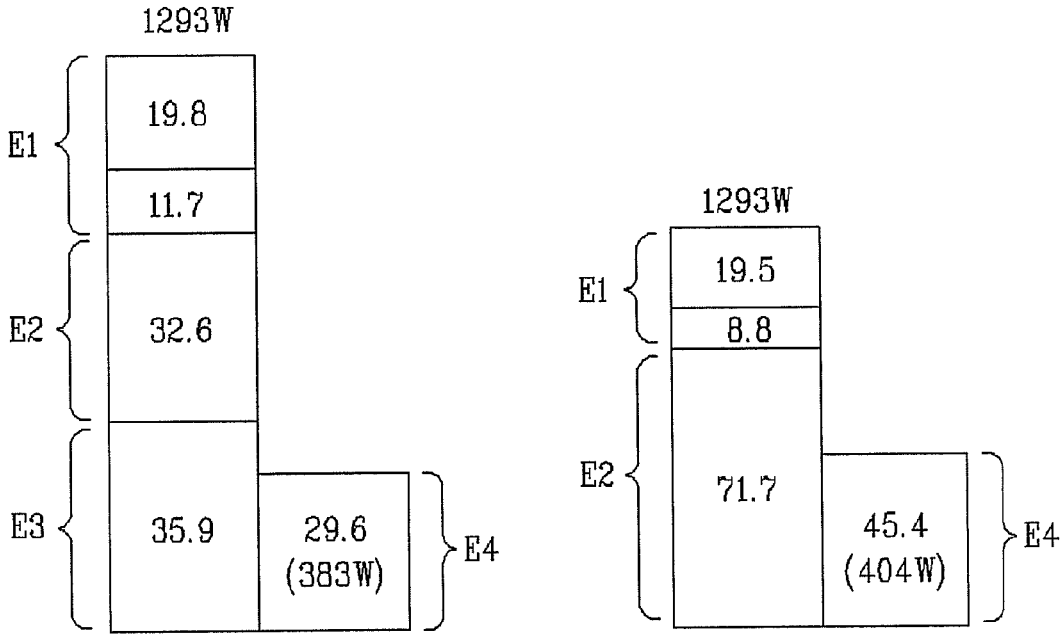
FIG. 14 is a diagram illustrating energy efficiency according to the related art and the second embodiment.

The laundry machine of this embodiment is more efficient than that of the related art in view of energy, as shown in FIG. 14. The left side of FIG. 14 illustrates energy efficiency of the laundry machine according to the related art while the right side of FIG. 14 illustrates energy efficiency of the laundry machine according to this embodiment. In FIG. 14, 'E1' represents lost energy, 'E2' represents energy discharged from the tub 100, 120, and 'E3' represents energy discharged from the condensed water. 'E4' represents energy used for drying, and is obtained by calculating energy required until water contained in the object to be dried is evaporated from a room temperature. In the laundry machine of the related art at the left side of FIG. 14, E2 includes energy loss of the hot air flowing into the condensing duct after passing through the space between the drum 300, 320, 340 and the tub 100, 120 without flowing into the drum 300, 320, 340.

As shown in FIG. 14, in the laundry machine of the related art at the left side of FIG. 14, energy efficiency of 29.6% approximately is obtained. However, in the laundry machine of this embodiment, energy efficiency of 45.4% approximately is obtained.

In this embodiment, the hot air almost flows into the drum 300, 320, 340, and the system temperature of the laundry machine is lower than that of the laundry machine according to the related art. Also, since no condensed water is used, energy loss due to supercooling does not occur.

Meanwhile, in the aforementioned embodiments, the space inside the tub is used as the condensing space. Namely, in the aforementioned embodiments, the tub serves as the condensing chamber. However, a separate condensing chamber may be provided. For example, the condensing duct may be used like the related art. In this case, the condensing chamber condenses water of the wet air flowing therein by exchanging heat with the outside air through natural convection. In other words, the condensing chamber may be provided separately from the tub. The condensing chamber may carry out condensing through natural cooling by natural convection.

Figure 15:
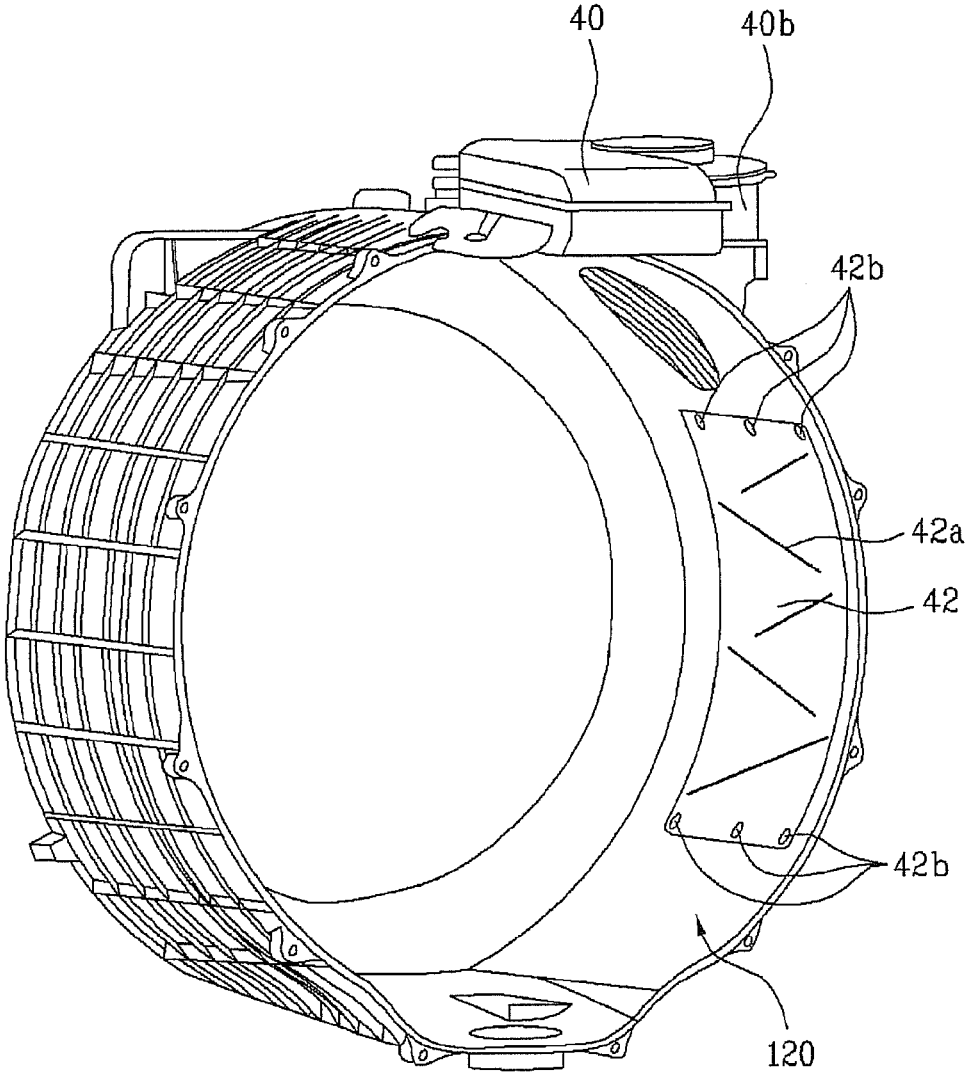
FIG. 15 and FIG. 16 are diagrams illustrating the third embodiment of the present invention.
Figure 16:
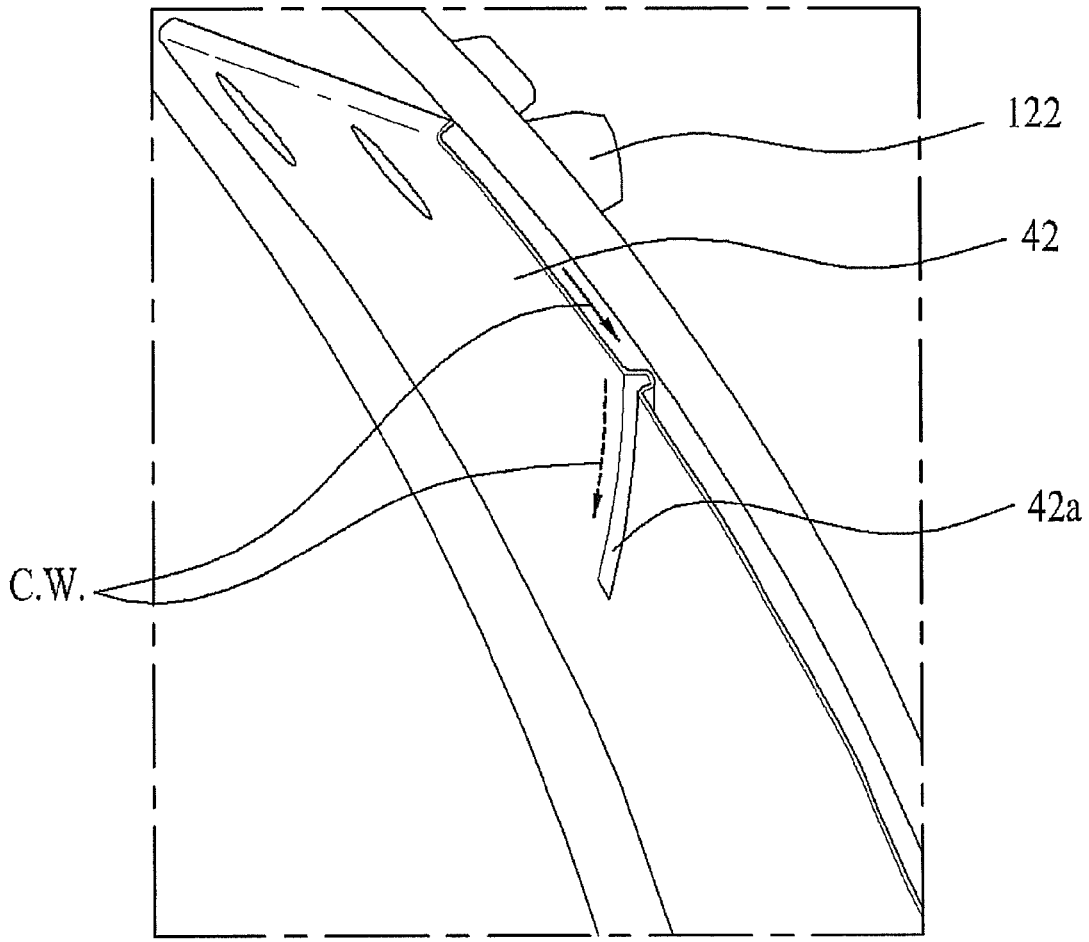

Also, in the aforementioned embodiments, although condensing is carried out through natural cooling, cooling water or cooling air may be used for forcible cooling. For example, as shown in FIG. 15 and FIG. 16, a cooling water injection portion 122 may be formed at the tub 100, 120 so that cooling water c.w. may be injected into the tub 100, 120. FIG. 15 and FIG. 16 illustrates that the cooling water injection portion 122 is formed at the tub and a passage for flowing cooling water c.w. is formed at the condensing plate 42*a* in the embodiment in which the condensing plate 42 is used.

In this laundry machine, the cooling water injection portion 122 is formed at the tub layer 120. The cooling water injection portion 122 is formed below the hot air outlet.

The cooling water injection portion 122 may have a structure that the cooling water c.w. is injected into the space between the tub and the drum. Alternatively, the cooling water injection portion 122 may have a structure that the cooling water c.w. flows along the inner wall of the tub. In this embodiment, the cooling water c.w. is supplied between the condensing plate 42 and the wall of the tub and then flows along the condensing plate 42. The cooling water c.w. may be discharged to a drainage hole formed below the tub.

A cooling water passage may be formed at the condensing plate 42 so that the cooling water c.w. may flow in a zigzag shape. The cooling water passage is formed by a groove 42*a* formed in the condensing plate.

FIG. 16 illustrates a section of the condensing plate 42 mounted on the inside of the tub. As shown in FIG. 16, the groove 42*a* is formed in the condensing plate 42 towards the wall of the tub to form the cooling water passage. In other words, the groove 42*a* is formed in a way that a surface of the condensing plate 42 facing the wall of the tub is projected towards the inner surface of the tub, whereby the passage is formed between the wall of the tub and the condensing plate 42.

At this time, edges of upper and lower ends of the condensing plate 42 are bent towards the wall of the tub to stop the upper and lower portions of the space where the cooling water c.w. flows. This is to prevent the hot air from flowing into the space where the cooling water c.w. flows if possible. If the cooling water c.w. is exposed to the hot air, particles of the cooling water may flow into the drying duct 40 due to the hot air.

Meanwhile, unlike the embodiment shown in FIG. 15 and FIG. 16, the condensing plate may not be used. In other words, in the embodiment of FIG. 15 and FIG. 16, the cooling water may be injected into the tub through the cooling water injection portion 122. In this case, the cooling water injection portion 122 may be formed so that the cooling water flows along the wall of the tub.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

INDUSTRIAL APPLICABILITY

The present invention relates to a laundry machine having a drying function for drying an object to be dried, especially clothes. The laundry machine according to one embodiment of the present invention may be a circulating drying machine that supplies the hot air to an object to be dried, so as to remove water, and then condenses the water from the hot air and heats the condensed water to supply the heat to the object to be dried. At this time, condensing may be carried out using natural convection.

What is claimed is:

1. A laundry treatment apparatus, comprising a drum configured to rotate;

a heater and a fan configured to generate hot air and to supply the hot air to a drying duct that guides the hot air to the drum;

a tub surrounding the drum, the tub forming a condensing device that provides for heat exchange to condense moist air discharged from the drum and allow formation of condensed water, the tub including a hot air outlet provided at an upper tear portion of an outer circumferential wall of the tub, a rim provided at a front end of the tub and a hot air inlet provided at an upper front portion of the rim, and a front gasket coupled to the front portion of the rim of the tub provided with a duct connection portion inserted into the hot air inlet, the hot air inlet supplying, hot air into the tub through the duct connection portion of the front gasket coupled to the rim, wherein a top portion of the rim extends further from the front end of the tub than a bottom portion of the rim.

2. The apparatus of claim 1, wherein the hot air inlet and the hot air outlet of the tub are configured such that an angle formed between a direction of hot air introduced through the hot air inlet and a direction of hot air discharged through the hot air outlet is within 10 degrees.

3. The apparatus of claim 1, wherein the hot air inlet is formed at a position on the tub that is forward of a laundry introduction port formed at the front portion of the drum.

4. The apparatus of claim 1, wherein the condensing device formed by the rub is configured to perform heat exchange with external, air through natural convection at an outside of the tub, and to condense the discharged moist air at an inside of the tub.

5. The apparatus of claim 1, wherein at least 40% of the inner circumferential surface of the rub forms a condensing surface at which the condensed water is accumulated.

6. The apparatus of claim 1, wherein the hot air is introduced from the drying duct into the drum to absorb moisture evaporated from laundry items received in the drum, and hot moist air is discharged from the drum to a condensing space formed between the tub and the drum such that the discharged hot moist air is condensed in the condensing space and then discharged from the condensing space, and the air discharged from the condensing space is introduced back into the drying duct so as to circulate the hot air.

7. The apparatus of claim 1, wherein the drying duct is connected to the tub such that 50% or more of hot air discharged from the drying duct is introduced into the drum.

8. The apparatus of claim 1, wherein the drying duct is connected to the tub such that hot air is ejected downward into the drum.

9. The apparatus of claim 8, wherein the hot air is ejected to a door glass.

10. The apparatus of claim 1, wherein a temperature inside the drum is greater than a temperature of a space between the tub and the drum.

11. The apparatus of claim 10, wherein the temperature inside the drum is first temperature taken at a central portion of an interior of the drum, and the temperature of the space between the tub and the drum is a second temperature taken at a central portion of the space between the tub and the drum.

12. The apparatus of claim 11, wherein the second temperature is taken at a point intersecting a horizontal line passing through and extending from the point at which the first temperature is taken.

13. The apparatus according to claim 10, wherein the temperature inside the drum is an interior temperature of the drum, and the temperature of the space between the tub and the drum is an interior temperature of the tub, taken at a lower portion of the tub.

14. The apparatus of claim 1, wherein a maximum surface temperature of the tub is less than 140 degrees.

15. The apparatus of claim 14, wherein a maximum surface temperature of the tub is less than 100 degrees.

16. The apparatus of claim 1, wherein a maximum temperature of the hot air inlet is less than 160 degrees.

17. The apparatus of claim 16, wherein a maximum temperature of the hot air inlet is less than 140 degrees.

18. The apparatus of claim 1, wherein an average temperature of the hot air inlet is less than 140 degrees.

19. The apparatus of claim 18, wherein an average temperature of the hot air inlet is less than 120 degrees.

20. The apparatus of claim 1, wherein a maximum temperature differential of the hot air inlet is less than 65 degrees.

21. The apparatus of claim 20, a maximum temperature differential of the hot air inlet is less than 40 degrees.

22. The apparatus of claim 1, wherein a difference between an average temperature of the hot air inlet and a temperature at the blowing fan in the drying duct is less than or equal to 30 degrees.

23. The apparatus of claim 22, wherein the difference between the average temperature of the hot air inlet of the tub and the temperature at the blowing fan is less than or equal to 22 degrees.

24. The apparatus of claim 1, wherein a temperature in the blowing fan at the drying duct is greater than or equal to 90 degrees.

25. The apparatus of claim 1, wherein the hot air is supplied to the drum at an air flow rate of greater than 1.5 $m^3$/min for a predetermined period of time during a drying cycle.

26. The apparatus of claim 25, wherein resistance in a circulation channel in which the hot air flows has a constant pressure of less than 170 Pa when the air flow rate of the hot air is 1.5 $m^3$/min.

27. The apparatus of claim 26, wherein the air flow rate of the hot air is 1.59 to 1.95 $m^3$/min/min.

28. The apparatus of claim 1, wherein a flow path of hot air passing through the hot :air inlet and the hot air outlet and a flow path of hot air moved by the fan are formed in parallel to each other.

* * * * *